US008152007B2

(12) United States Patent
Ito et al.

(10) Patent No.: US 8,152,007 B2
(45) Date of Patent: Apr. 10, 2012

(54) AUTOMATIC COUPLER FOR MODEL RAILROAD CAR

(75) Inventors: Seiichi Ito, Tokyo (JP); Yoshihiro Imon, Tokyo (JP)

(73) Assignee: Imon Corporation, Tokyo (JP)

( * ) Notice: Subject to any disclaimer, the term of this patent is extended or adjusted under 35 U.S.C. 154(b) by 114 days.

(21) Appl. No.: 12/855,230

(22) Filed: Aug. 12, 2010

(65) Prior Publication Data

US 2011/0036800 A1 Feb. 17, 2011

(30) Foreign Application Priority Data

Aug. 17, 2009 (JP) ..... 2009-188371

(51) Int. Cl.
*A63H 19/18* (2006.01)

(52) U.S. Cl. ..... 213/75 TC; 105/1.5

(58) Field of Classification Search ..... 213/75 TC; 105/1.5; 104/DIG. 1

See application file for complete search history.

(56) References Cited

U.S. PATENT DOCUMENTS 3,469,713 A * 9/1969 Edwards et al. ..... 213/75 TC
5,931,322 A * 8/1999 Storzek ..... 213/75 TC
7,383,962 B2 * 6/2008 Webster et al. ..... 213/75 TC

FOREIGN PATENT DOCUMENTS

JP 2002331177 11/2002

* cited by examiner

*Primary Examiner* — S. Joseph Morano
*Assistant Examiner* — Zachary Kuhfuss
(74) *Attorney, Agent, or Firm* — Volpe and Koenig, P.C.

(57) ABSTRACT

In an automatic coupler for a model railroad car, a coupler body includes a knuckle coupler member formed of a coupler trunk having a knuckle portion and an engagement portion, and a receiving coupler member formed of a coupler trunk having a receiving portion and an engagement portion. A holder includes a lower holder member having a holder plate, a holder shaft projecting from the holder plate and adapted to engage with the engagement portions, and a spring portion adapted to surround the engagement portions. The holder plate, holder shaft, and the spring portion are integrally formed, and an upper holder member is adapted to be fixed to the lower holder member with the coupler body interposed between. The coupler body and the holder have a guide mechanism that allows the coupler body to follow a curve when the car travels on the curve.

4 Claims, 5 Drawing Sheets

AUTOMATIC COUPLER FOR MODEL RAILROAD CAR

BACKGROUND OF THE INVENTION

1. Field of the Invention

This invention relates to an automatic coupler for a model railroad car.

2. Description of the Related Art

For coupling model railroad cars, various types of automatic couplers adapted to be coupled in an automatic manner, including the Arnold type coupler, have been proposed.

For example, there has been proposed an automatic coupler comprising a coupler body enclosed in a holder case fixed to a model railroad car body, in a manner that the coupler body is allowed to swing from side to side, the coupler body including a knuckle portion of a hook-like shape open at one side, when viewed from above, and a receiving portion of a thumb-like shape facing the open side of the knuckle portion (see Japanese Patent Application Laid-open No. 2002-331177). In this automatic coupler, normally, a coil spring retains the coupler body in a standard position, and thus, retains the receiving portion in an engagement position relative to the knuckle position, or position in which the receiving portion is a minimum distance away from the open side of the knuckle position. The automatic coupler includes a metal rod projecting from the underside of the coupler body obliquely downward, and by this metal rod being attracted toward the knuckle portion side by a magnet placed between rails, the automatic coupler is uncoupled. The automatic coupler is thus adapted to be coupled and uncoupled in an automatic manner.

In real railroad cars, couplers are very small compared with car bodies, according to which, couplers for model railroad cars are very small. It is therefore desirable that the coupler for model railroad cars should be composed of a small number of components and easy to assemble.

The automatic coupler disclosed in the above publication, however, includes a coil spring for retaining the coupler body in the standard position and thus retaining the receiving portion in the engagement position relative to the knuckle portion, and a metal rod projecting from the underside of the coupler body obliquely downward and adapted to be attracted toward the knuckle portion side by a magnet placed between rails. This automatic coupler is thus complicated in structure and composed of a large number of components, and accordingly, difficult to assemble and expensive.

SUMMARY OF THE INVENTION

An object of the present invention is provide an automatic coupler for a model railroad car, very similar in shape to the real automatic coupler but simple in structure and composed of a small number of components, and thus easy to assemble and moderate in price.

In order to achieve the above object, an automatic coupler for a model railroad car according to the present invention comprises a coupler body and a holder for holding the coupler body in a manner allowing the coupler body to swing from side to side, said coupler body including a knuckle portion and a receiving portion provided at a distal end of a coupler trunk, said knuckle portion being a hook-like shape open at one side, when viewed from above, said receiving portion being a thumb-like shape facing the open side of the knuckle portion and adapted to shift between an engagement position in which the receiving portion is a minimum distance away from the open side of the knuckle portion and a release position in which the receiving portion is a maximum distance away from the open side of the knuckle portion, said holder being adapted to be fixed to an end of a model railroad car, wherein said coupler body is composed of a knuckle coupler member and a receiving coupler member, said knuckle coupler member is formed of a trunk provided with said knuckle portion at a distal end and an engagement portion of an approximate U-shape, when viewed from above, at a proximal end, said receiving coupler member is formed of a trunk provided with said receiving portion at a distal end and an engagement portion of an approximate U-shape, when viewed from above, at a proximal end, said knuckle coupler member and said receiving coupler member are combined in a manner allowing relative turning motion between them, thereby allowing said receiving portion to shift between said engagement position and said release position, said holder is composed of a lower holder member and an upper holder member, said lower holder member includes a holder plate, a holder shaft and a spring portion integrally formed, said holder plate supporting said coupler body under a part of the coupler trunk nearer to the proximal end and an engagement portion of the coupler body composed of said engagement portions of the knuckle coupler member and the receiving coupler member, said shaft projecting from the holder plate and adapted to engage with said engagement portion of the coupler body in a manner allowing said coupler body to swing from side to side, said spring portion being adapted to surround said engagement portion of the coupler body engaged with the holder shaft and including end portions adapted to contact and push on the opposite sides of the coupler trunk, in a region nearer to the proximal end, thereby retaining the coupler body in a standard position, said upper holder member is adapted to be fixed to the lower holder member with the coupler body interposed between, thereby covering a part of the coupler trunk nearer to the proximal end and the engagement portion of the coupler body, and said coupler body and said holder have a guide mechanism for fitting the coupler body to the holder and allowing the coupler body to follow a curve when the car travels on the curve.

As understood from above, in the automatic coupler for the model railroad car according to the present invention, the coupler body is assembled by combining the knuckle coupler member, formed of a trunk provided with a knuckle portion at a distal end and an engagement portion of an approximate U-shape at a proximal end, and the receiving coupler member, formed of a trunk provided with a receiving portion at a distal end and an engagement portion of an approximate U-shape at a proximal end. In the coupler body thus assembled, relative turning motion between the knuckle coupler member and the receiving coupler member is allowed, so that the receiving portion can shift between the engagement position and the release position. The coupler body is mounted on the lower holder member with the engagement portion of the coupler body fitted between the holder shaft and the spring portion, and the coupler trunk fitted between the end portions of the spring portion, where the holder plate supports the coupler body under a part of the coupler trunk nearer to the proximal end and the engagement portion of the coupler body. Then, the upper holder member is placed over the coupler body and fixed to the lower holder member. The coupler body is thus enclosed in the holder. Although the coupler body is normally retained in a standard position by the spring portion, the guide mechanism allows the coupler body to turn against the force exerted by the spring portion to follow a curve when the car travels on the curve.

The above-described automatic coupler thus enables smooth travel of the car on a curve, and at the same time presents an improved appearance.

The present invention can thus provide an automatic coupler for a model railroad car very similar in shape to the real automatic coupler but simple in structure and composed of a small number of components, and thus easy to assemble and moderate in price.

A further scope of applicability of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

With reference to the drawings attached, an automatic coupler for a model railroad car according to an embodiment of the present invention will be described below.

Figure 1:
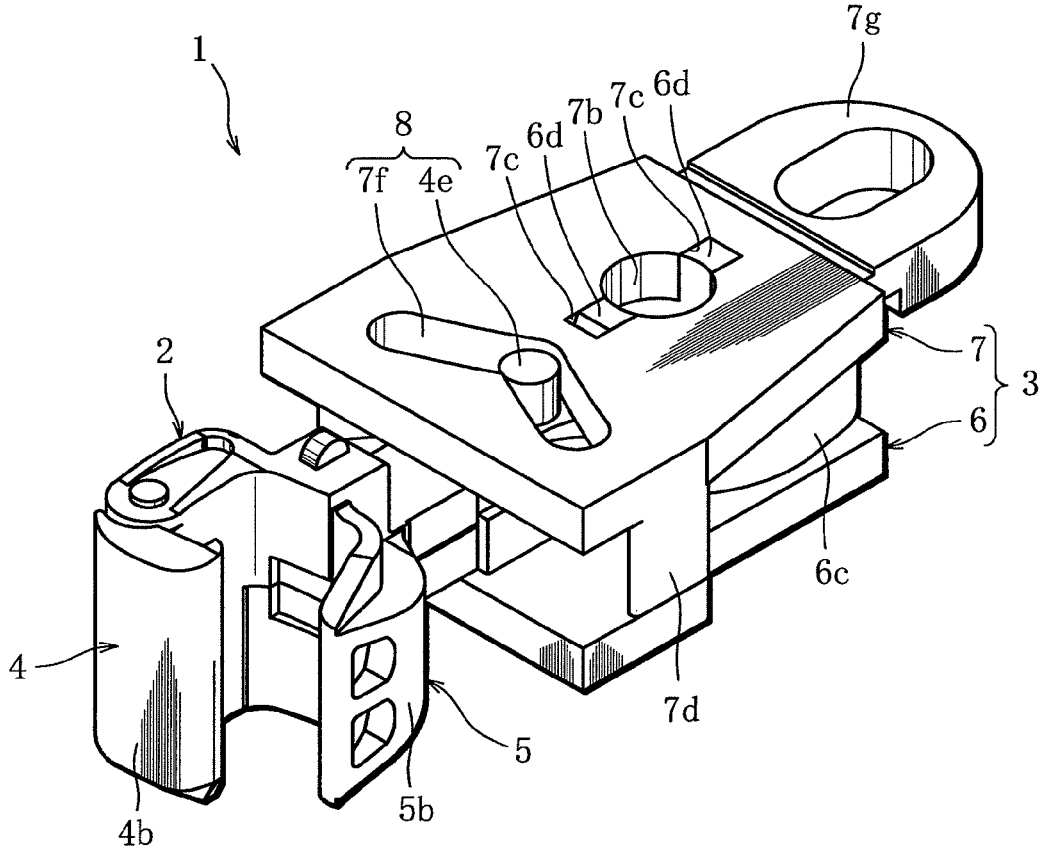
FIG. 1 is a perspective view of an automatic coupler for a model railroad car according to the present invention.

As shown in FIG. 1, an automatic coupler (hereinafter referred to simply as "coupler") 1 comprises a coupler body 2 and a holder 3 for holding the coupler body 2. The coupler body 2 is composed of a knuckle coupler member 4 having a knuckle portion 4*b* and a receiving coupler member 5 having a receiving portion 5*b*. The holder 3, on the other hand, is composed of a lower holder member 6 and an upper holder member 7.

Figure 2:
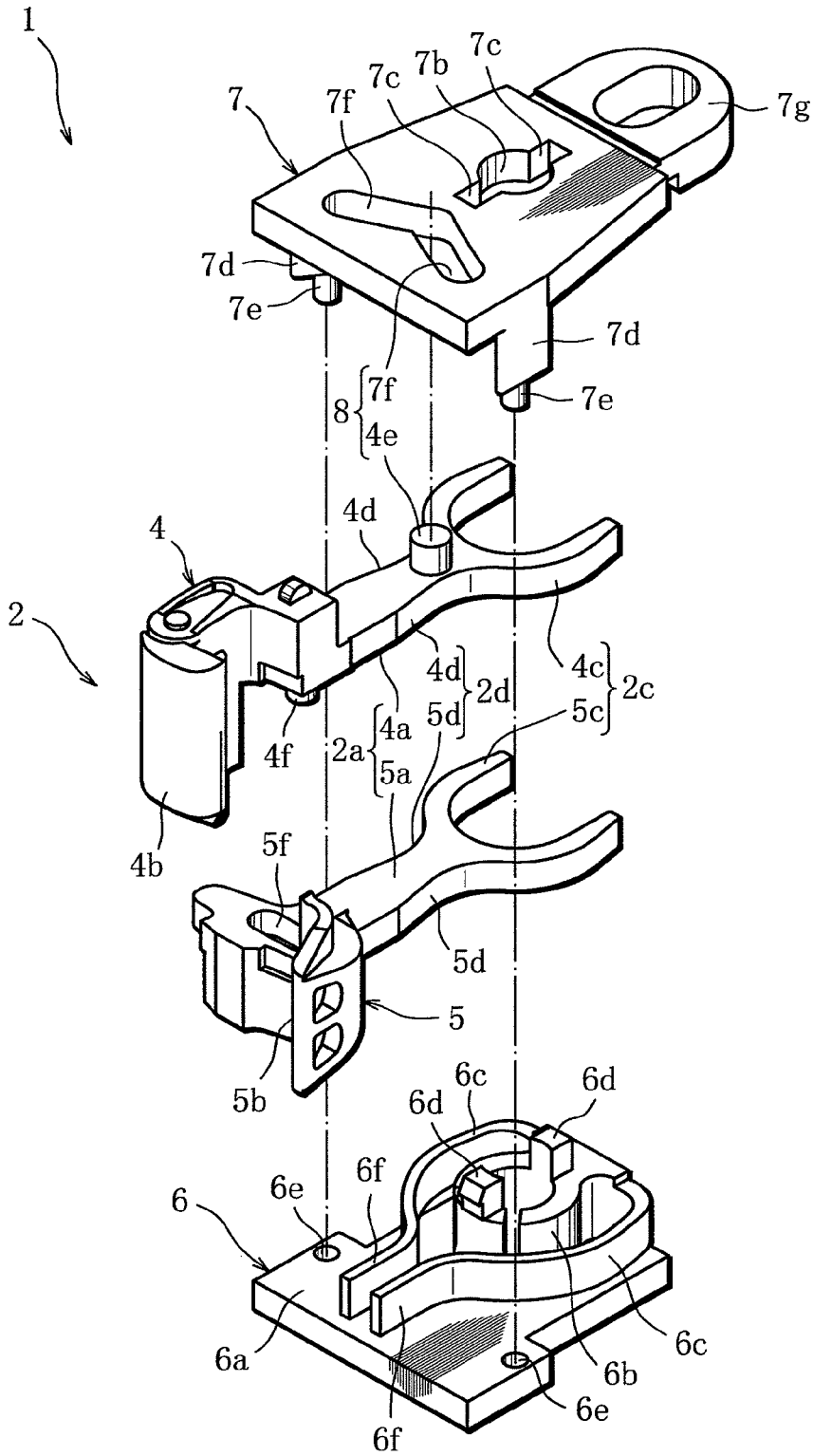
FIG. 2 is an exploded perspective view of the automatic coupler shown in FIG. 1.

As shown in FIG. 2, the knuckle coupler member 4 of the coupler body 2 is formed of a coupler trunk 4*a* of a rod-like shape provided with a knuckle portion 4*b* of a hook-like shape open at one side, when viewed from above, at a distal end, and an engagement portion 4*c* of an approximate U-shape, when viewed from above, at a proximal end. The engagement portion 4*c* is greater in width than the coupler trunk 4*a*. When viewed from above, the coupler trunk 4*a* tapers, or becomes smaller in width, in a manner that the opposite sides 4*d* gradually approach each other, approximately from the middle up to the engagement portion 4*c*.

A guide pin 4*e* is provided on the upper surface of the coupler trunk 4*a*, at a position adjacent to the engagement portion 4*c* and widthwise central, to project upward, while a stopper pin 4*f* is provided on the lower surface of the coupler trunk 4*a*, at a position adjacent to the knuckle portion 4*b* and widthwise central, to project downward.

The receiving coupler member 5 of the coupler body 2, on the other hand, is formed of a coupler trunk 5*a* of a rod-like shape provided with a receiving portion 5*b* of a thumb-like shape facing the open side of the knuckle portion 4*b*, when viewed from above, at a distal end, and an engagement portion 5*c* of an approximate U-shape, when viewed from above, at a proximal end. The engagement portion 5*c* is greater in width than the coupler trunk 5*a*. When viewed from above, the coupler trunk 5*a* tapers, or becomes smaller in width, in a manner that the opposite sides 5*d* gradually approach each other, approximately from the middle up to the engagement portion 5*c*.

A transversely elongated hole 5*f* (elongated in the left-to-right direction) is provided in the upper surface of the coupler trunk 5*a*, at a position adjacent to the receiving portion 5*b* and widthwise central, to correspond to the stopper pin 4*f*. As described later, the elongated hole 5*f* is adapted to receive the stopper pin 4*f* and allows the receiving portion 5*b* to shift relative to the knuckle portion 4*b*, between an engagement position in which the receiving portion 5*b* is a minimum distance away from the open side of the knuckle portion 4*b* and a release position in which the receiving portion 5*b* is a maximum distance away from the open side of the knuckle portion 4*b*.

The coupler trunk 4*a* and engagement portion 4*c* of the knuckle coupler member 4 are identical in shape to the coupler trunk 5*a* and engagement portion 5*c* of the receiving coupler member 5 so that the knuckle coupler member 4 can be placed over the receiving coupler member 5 with the coupler trunk 4*a* and engagement portion 4*c* in agreement with the coupler trunk 5*a* and engagement portion 5*c*.

The knuckle coupler member 4 and the receiving coupler member 5 are each integrally formed from resin such as plastic, such that the knuckle portion 4*b* and the receiving portion 5*b* have shapes very similar to the knuckle portion and the receiving portion of an automatic coupler fitted to a real railroad car. The coupler body 2 is assembled by placing the knuckle coupler member 4 over the receiving coupler member 5 with the coupler trunk 4*a* and engagement portion 4*c* in agreement with the coupler trunk 5*a* and engagement portion 5*c*, and the stopper pin 4*f* fitted in the elongated hole 5*f*.

To make the description simple, the coupler trunks 4*a* and 5*a*, the engagement portions 4*c* and 5*c*, and the sides 4*d* and 5*d* of the knuckle coupler member 4 and the receiving coupler member 5 thus stacked will be referred to as a coupler trunk 2*a*, an engagement portion 2*c* and a side 2*d* of the coupler body 2, respectively.

In other words, the coupler body 2 is divided into two members vertically stacked, where the upper member is formed of a coupler trunk 4*a* provided with a knuckle portion 4*b* at a distal end and an engagement portion 4*c* at a proximal end, and the lower member is formed of a coupler trunk 5*a* provided with a receiving portion 4*b* at a distal end and an engagement portion 5*c* at a proximal end. A stopper pin 4*f* provided on the lower surface of the upper member, at the distal end of the coupler trunk 4*a*, is fitted in an elongated hole 5*f* provided in the upper surface of the lower member, at the distal end of the coupler trunk 5*a*, to allow relative turning motion between the knuckle coupler member 4 and the receiving coupler member 5, thereby allowing the receiving portion 5*b* to shift relative to the knuckle portion 4*b*, between the engagement position and the release position.

The lower holder member 6 comprises a holder plate 6*a* supporting the coupler body 2 under a part of the coupler trunk 2*a* nearer to the proximal end and the engagement portion 2*c*, a holder shaft 6*b* for allowing the coupler body 2 to swing from side to side, and a spring portion 6*c* for retaining the coupler body 2 in a standard position.

The holder shaft 6*b*, in the shape of a hollow cylinder, projects upward from the holder plate 6*a*, on a rear side (the side on which the engagement portion 2*c* is located), at a widthwise central position, and has, on its top face, plural, for example two engagement claws 6*d* circumferentially equally spaced apart. The coupler body 2 is mounted on the lower holder member 6 with the engagement portion 2*c* in sliding contact with the outer circumference of the holder shaft 6*b*, and thus allowed to turn. The holder plate 6*a* also has holes 6*e* in its forward part, on either side, for use in fixing the upper holder member 7 to the lower holder member 6.

The spring portion 6*c* is of a thin plate-like shape and extends symmetrically on the left and right sides. More specifically, the spring portion 6*c* circularly surrounds the holder shaft 6*b* concentrically, and is constricted near the front end such that the front end portions 6*f*, 6*f* extend approximately parallel to each other with a front-to-back central line interposed, up to near the front end of the holder plate 6*a*. The width of the spring portion 6*c* is slightly smaller than the height of the holder shaft 6*b* so that the spring portion 6*c* is arranged with its lower edge slightly above the holder plate 6*a* and its upper edge slightly below the top face of the holder shaft 6*b*, and thus allowed to be deformed.

The space between the holder shaft 6*b* and the spring portion 6*c* is adapted to receive the engagement portion 2*c* of the coupler body 2 in a manner allowing the coupler body 2 to turn. The distance between the front end portions 6*f*, 6*f* is slightly smaller than the width of the coupler trunk 2*a* to ensure that the front end portions 6*f*, 6*f* contact the opposite sides 2*d* of the coupler body 2, each formed of the sides 4*d* and 5*d*, in a region nearer to the proximal end.

The lower holder member 6 is integrally formed from resin such as plastic to ensure that the spring portion 6 has elasticity. Such integral forming of the lower holding member 6 comprising the holder plate 6*a*, the holder shaft 6*b* and the spring portion 6*c* offers advantages such as a reduction in the number of components and ease of assembly, which will be described later.

The upper holder member 7 is a plate-shaped member approximately equal in size to the holder plate 6*a* of the lower holder member 6, and has a hole 7*b* of a diameter approximately equal to the inside diameter of the holder shaft 6*b*, at a position corresponding to the holder shaft 6*b*, and engagement holes 7*c* adapted to receive the engagement claws 6*d*, in the inner surface of the hole 7*b*. The upper holder member 7 has also, in its forward part, holder legs 7*d* extending downward from the lower surface, on either side, to correspond to the holes 6*e* in the lower holder member 6. Each holder leg 7*d* has, at its lower end, a projection 7*e* adapted to fit in the hole 6*e*. The length of the holder legs 7*d* is equal to the length of the holder shaft 6*b* of the lower holder member 6.

The upper holder member 7 further has a guide groove 7*f* adapted to receive the guide pin 4*e* of the knuckle coupler member 4, to the front side of the hole 7*b*. The guide groove 7*f* includes two parts extending from a point near the hole 7*b*, diagonally to the left and right sides, toward the front end of the upper holder member 7, and thus having an approximate flatten V-shape as a whole. The guide groove 7*f* and the guide pin 4 constitute a guide mechanism 8 for fitting the coupler body 2 to the upper holder member 7 and allowing the coupler body 2 to be drawn forth from the holder 3 to follow a curve when the car travels on the curve.

The upper holder member 7 has also, at its rear end, a fitting portion 7*g* adapted to be fixed at the end of the car. Also the upper holder member 7 is formed from resin such as plastic.

Next, the assembly and function of the above-described coupler 1 will be described.

First, as shown in FIG. 2, the coupler body 2 is assembled by placing the knuckle coupler member 4 over the receiving coupler member 5 with the coupler trunk 4*a* and engagement portion 4*c* in agreement with the coupler trunk 5*a* and engagement portion 5*c*, and the stopper pin 4*f* fitted in the elongated hole 5*f*.

Figure 3:
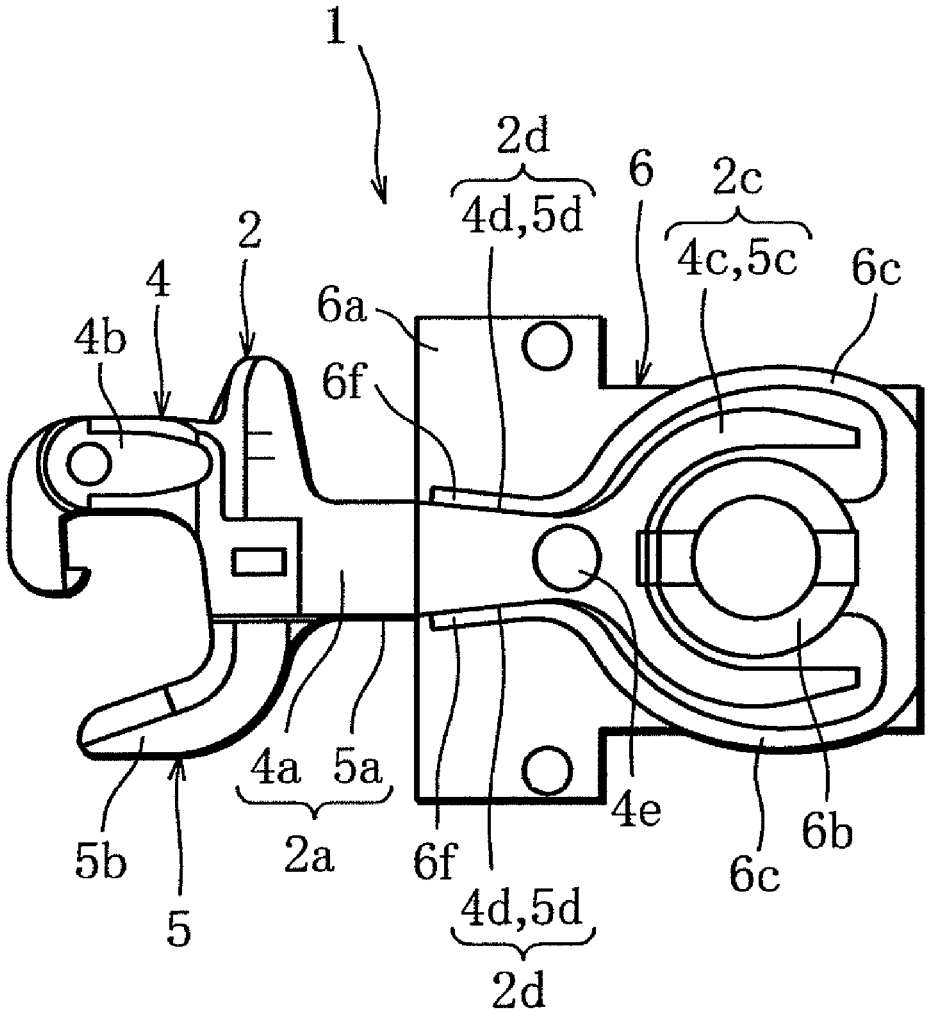
FIG. 3 is a top plan view showing a coupler body mounted on a lower holder member of the automatic coupler shown in FIG. 2.

Then, as shown in FIG. 3, the coupler body 2 is mounted onto the lower holder member 6 from above so that the engagement portion 2*c* is received between the holder shaft 6*b* and the spring portion 6*c* and the coupler trunk 2*a* is received between the front end portions 6*f*, 6*f* of the spring portion 6*c*.

Here, the front end portions 6*f*, 6*f* are elastically in contact with the opposite sides 4*d* of the tapered coupler trunk 4*a* and the opposite sides 5*d* of the tapered coupler trunk 5*a*, thereby retaining the knuckle coupler member 4 and the receiving coupler member 5, and thus, the coupler body 2 in a standard position as shown in FIG. 3, or in other words, keeping the coupler body 2 drawn back in the holder 3.

Then, as shown in FIG. 2, the upper holder member 7 is placed over the coupler body 2 to cover a part of the coupler trunk 2*a* nearer to the proximal end and the engagement portion 2*c*, with the guide pin 4*e* fitted in the guide groove 7*f*, the engagement claws 6*d* of the holder shaft 6*b* fitted in the engagement holes 7*c*, and the projections 7*a* at the lower ends of the holder legs 7*d* pushed in the holes 6*e* of the lower holder member 6.

By fixing the upper holder member 7 to the lower holder member 6 with the coupler body 2 interposed between them in this manner, the coupler 1 is completed.

Figure 4:
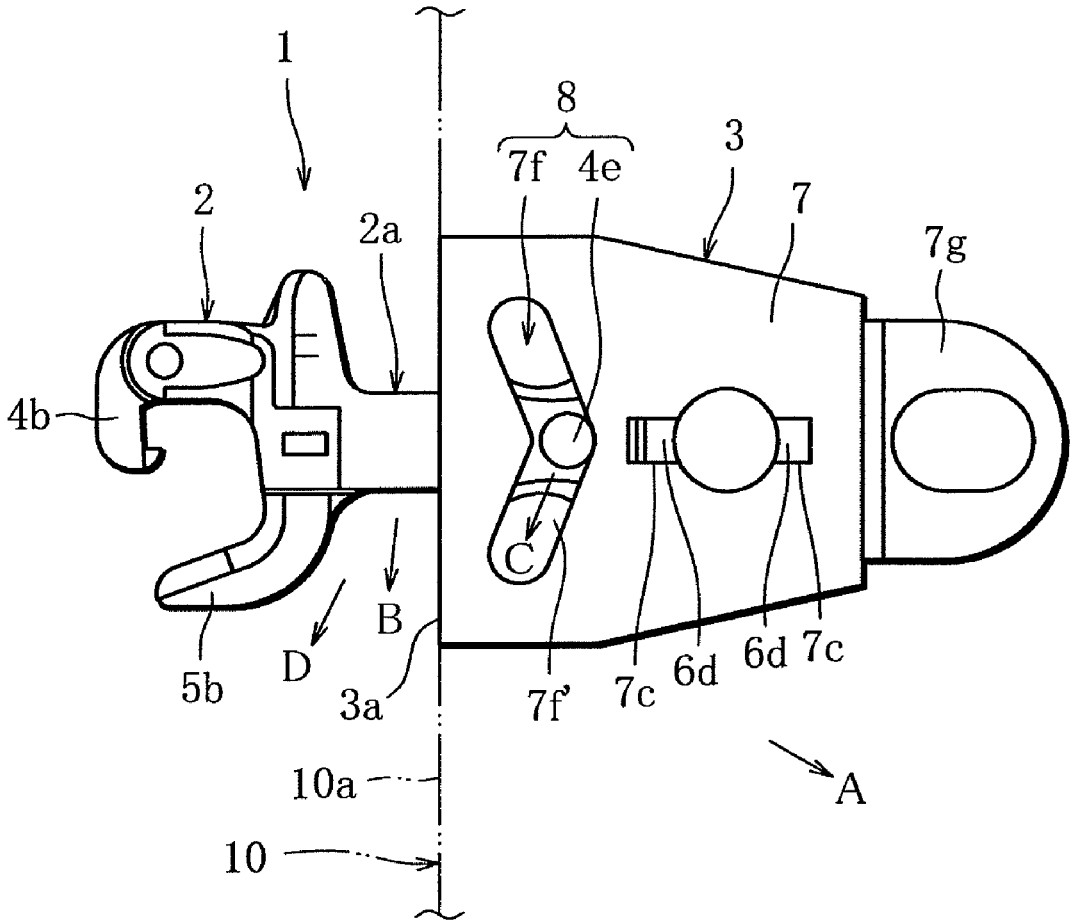
FIG. 4 is a top plan view of the automatic coupler shown in FIG. 1.
Figure 5:
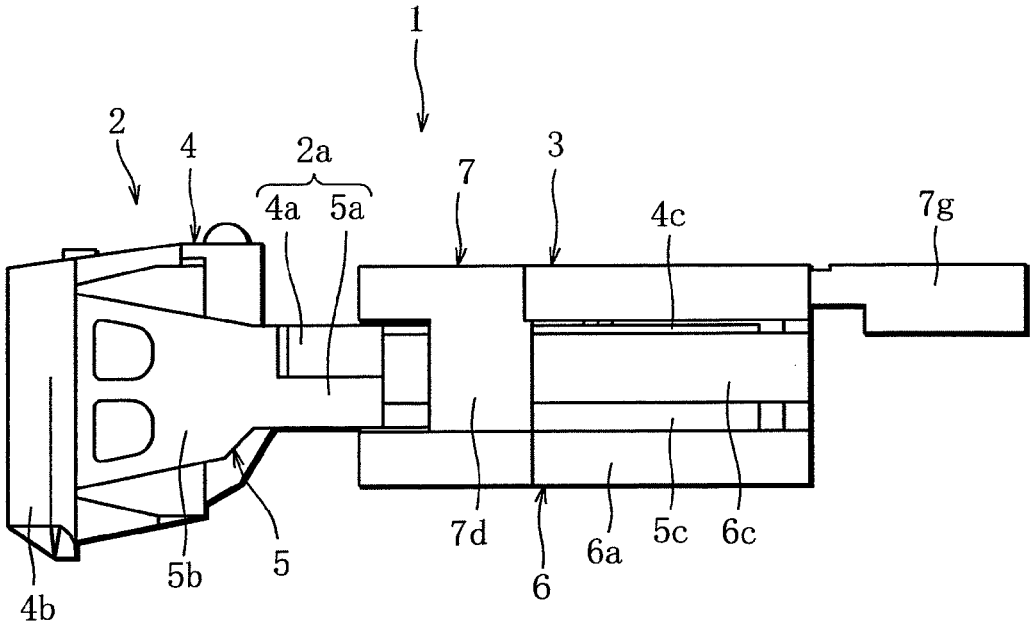
FIG. 5 is a side view of the automatic coupler shown in FIG. 1.

When the coupler body 2 is in the standard position as shown in FIG. 3, the guide pin 4*e* is located at the center of the guide groove 7*f* as shown in FIG. 4 and prevents the coupler body 2 from coming off the holder 3. The forward part of the coupler body 2, including the forward part of the coupler trunk 2*a*, the knuckle portion 4*b* and the receiving portion 5*b*, projects from the front end 3*a* of the holder 3. The spring portion 6*c* extends with its lower edge slightly apart from the holder plate 6*a* of the lower holder member 6 and its upper edge slightly apart from the upper holder member 7, as shown in FIG. 5, and thus, is allowed to be deformed.

The knuckle coupler member 4 and the receiving coupler member 5 are vertically stacked to form the coupler body 2, where the coupler trunk 4*a* and the engagement portion 4*c* are in agreement with the coupler trunk 5*a* and the engagement portion 5*c*, respectively, and the spring portion 6*c* pushes on the sides 4*d*, 5*d* on either side, thereby retaining the receiving portion 5*b* in the engagement position relative to the knuckle portion 4*b*, or position in which the receiving portion 5*b* is a minimum distance away from the open side of the knuckle portion 4*b*, as shown in FIGS. 1, 3 and 4.

The coupler 1 is fitted to the model car 10 by fixing the fitting portion 7*g* of the upper holder member 7 to the end 10*a* of the model car 10 indicated by a two-dot chain line in FIG. 4, with a screw not shown, where the front end 3*a* of the holder 3 is approximately at the same height as the end 10*a* of the model car 10, and the forward part of the coupler body 2, including the forward part of the coupler trunk 2*a*, the knuckle portion 4*b* and the receiving portion 5*b*, projects from the end 10*a* of the model car 10*a*. The coupler 1 is thus fitted to the model car in a manner very similar to a coupler fitted to a real car, and offers an improved appearance.

When viewed in FIG. 4, a coupler fitted to another model train, not shown, is coupled with the coupler 1 of the model car 10, on the left side of the coupler 1. The coupler of the model car to be coupled with the model car 10 is similar in structure to the coupler 1. When coupling the coupler 1 with its pair coupler, the receiving portion 5*b* of the coupler 1 and the receiving portion of the pair coupler are each kept in the engagement position, or position in which the receiving portion is a minimum distance away from the open side of the knuckle portion. In this state, the coupler 1 is pressed onto the pair coupler, so that the knuckle portion 4*b* of the coupler 1 pushes on the receiving portion of the pair coupler sideways toward the release position, or position in which the receiving portion is a maximum distance away from the knuckle portion, and at the same time, the knuckle portion of the pair coupler pushes on the receiving portion 5*b* of the coupler 1 sideways toward the release position.

With respect to the coupler 1, by virtue of combination of the stopper pin 4*f* and the elongated hole 5*f*, pushing on the receiving portion 5*b* toward the release position in this manner causes the receiving coupler member 5 to turn, against the force exerted on the coupler trunk 5*a* by the spring portion 6*c*, as shown in FIG. 3, and thus, causes the receiving portion 5*b* to shift relative to the knuckle portion 4*b*, from the engagement position to the release position. After the knuckle portion 4*b* of the coupler 1 engages with the knuckle portion of the pair coupler, the receiving coupler member 5 turns back to the standard position by virtue of the force exerted by the spring portion 6*c*, and thus, the receiving portion 5*b* returns to the engagement position. The pair coupler goes through the similar process. The coupler 1 and the pair coupler are thus coupled together.

As shown in FIG. 4, the forward part of the coupler body 2, including the forward part of the coupler trunk 2*a*, the knuckle portion 4*b* and the receiving portion 5*b*, projects from the end 10*a* of the model car 10, which prevents the ends of the coupled model cars from contacting each other when the cars travel on a straight track, although the cars coupled are close to each other as is the case with real cars.

Suppose that the model car 10 enters a curved track, and thus points diagonally as indicated by arrow A in FIG. 4, for example. In this situation, the coupler body 2 tends to turn as indicated by arrow B, against the force exerted by the spring portion 6*c*, so that the guide pin 4*e* shifts from the center of the guide groove 7 into the part 7*f* of the guide groove 7 corresponding to the inside of the curve, thus diagonally toward the front end of the upper holder member, as indicated by arrow C. Consequently, the coupler body 2 is drawn forth from the holder 3 to turn to the inside of the curve as indicated by arrow D.

Specifically, since the engagement portion 2*c* is an approximate U-shape open at the rear as shown in FIGS. 2 and 3, the coupler body 2 can be drawn forth without being prevented by the holder shaft 6*b*. Also the coupler body of the pair coupler coupled with the coupler 1, not shown, is drawn forth from the holder to turn to the inside of the curve in a similar manner.

The arrangement allowing the coupler body 2 to turn to follow a curve enables smooth travel of the car. Drawing forth the coupler body 2 from the holder 3 results in an increase in distance between the coupled cars, which prevents the ends of the cars from contacting each other, and thus ensures satisfactory travel of the coupled cars even on a curve with a small radius of curvature. In addition, the coupler presents a good appearance even when the coupled cars travel on a curve with a small radius of curvature. When the coupled cars enter a straight track following the curve, the coupler body 2 of coupler 1 returns to and is retained in the standard position as shown in FIG. 4 by virtue of the spring portion 6*c*.

Although in the described embodiment, the coupler body 2 is formed from resin, it may be formed from a metal such as a zinc alloy, an aluminum alloy or the like by die-casting. Automatic couplings fitted to real cars have a backlash (play) between the mating surfaces of the coupler bodies engaged, so that when a train consisting of a locomotive and cars, coupled by such couplers, starts traveling, the coupler pairs make a noise successively, from the first coupler pair, or coupler pair coupling the locomotive and the first car, to the last coupler pair. Also the automatic couplers 1 for a model railroad car according to the above-described embodiment have a backlash (play) between the mating surfaces of the coupler bodies engaged. Thus, if the coupler body 2 is formed from a metal, the coupler pairs fitted to model cars can make a noise when the model cars start traveling, which suits consumers' taste, thus improving the consumers' satisfaction.

In the described embodiment, the coupler body 2 is divided into upper and lower members vertically stacked, where the upper member is formed of a coupler trunk 4*a* provided with a knuckle portion 4*b* at a distal end, and the lower member is formed of a coupler trunk 5*a* provided with a receiving portion 5*b* at a distal end. The coupler body 2 may, however, have a reverse arrangement such that the upper member is formed of a coupler trunk 5*a* provided with a receiving portion at a distal end and the lower member is formed of a coupler trunk 4*a* with a knuckle portion at a distal end.

In the described embodiment, the guide mechanism 8 is composed of a guide pin 4*e* provided on the upper surface of the upper coupler trunk 4*a* to project upward and a guide groove 7*f* in the upper holder member 7. The guide mechanism may, alternatively, be formed by providing a guide pin on the lower surface of the lower coupler trunk 5*a* to project downward, and providing a guide groove in the lower holder member 6.

The guide groove is not restricted to the approximate flattened V-shape. It may be another shape, for example an arc-shape or an elliptical shape.

What is claimed is:

1. An automatic coupler for a model railroad car, comprising a coupler body and a holder for holding the coupler body in a manner allowing the coupler body to swing from side to side, said coupler body including a knuckle portion and a receiving portion provided at a distal end of a coupler trunk, said knuckle portion being a hook-like shape open at one side, when viewed from above, said receiving portion being a thumb-like shape facing the open side of the knuckle portion and adapted to shift between an engagement position in which the receiving portion is a minimum distance away from the open side of the knuckle portion and a release position in which the receiving portion is a maximum distance away from the open side of the knuckle portion, said holder being adapted to be fixed to an end of a model railroad car, wherein said coupler body is composed of a knuckle coupler member and a receiving coupler member, said knuckle coupler member is formed of a trunk provided with said knuckle portion at a distal end and an engagement portion of an approximate U-shape, when viewed from above, at a proximal end, said receiving coupler member is formed of a trunk provided with said receiving portion at a distal end and an engagement portion of an approximate U-shape, when viewed from above, at a proximal end, said knuckle coupler member and said receiving coupler member are combined in a manner allowing relative turning motion between them, thereby allowing said receiving portion to shift between said engagement position and said release position, said holder is composed of a lower holder member and an upper holder member, said lower holder member includes a holder plate, a holder shaft and a spring portion integrally formed, said holder plate supporting said coupler body under a part of the coupler trunk nearer to the proximal end and an engagement portion of the coupler body composed of said engagement portions of the knuckle coupler member and the receiving coupler member, said shaft projecting from the holder plate and adapted to engage with said engagement portion of the coupler body in a manner allowing said coupler body to swing from side to side, said spring portion being adapted to surround said engagement portion of the coupler body engaged with the holder shaft and including end portions adapted to contact and push on the opposite sides of the coupler trunk, in a region nearer to the proximal end, thereby retaining the coupler body in a standard position, said upper holder member is adapted to be fixed to the lower holder member with the coupler body interposed between, thereby covering a part of the coupler trunk nearer to the proximal end and the engagement portion of the coupler body, and said coupler body and said holder have a guide mechanism for fitting the coupler body to the holder and allowing the coupler body to follow a curve when the car travels on the curve.

2. The automatic coupler according to claim 1, wherein said knuckle coupler member and said receiving coupler member are adapted to be stacked vertically to form the coupler body, where the trunks of the knuckle coupler member and the receiving coupler member form the upper and lower parts of the coupler trunk.

3. The automatic coupler according to claim 1, wherein said guide mechanism is composed of a guide pin provided on an upper or lower surface of the coupler trunk, in a part of the coupler trunk nearer to the proximal end, and a guide groove provided in the upper or lower holder member, the guide groove including two parts extending from a point nearer to the proximal end of the upper or lower holder member, diagonally to the opposite sides, toward the distal end of the upper or lower holder member, and thus having an approximate V-shape as a whole, wherein the guide groove is adapted to receive said guide pin in a manner preventing the coupler body from coming off the holder and allowing the guide pin to shift into such one of said two parts of the guide groove that corresponds to an inside of a curve when the car travels on the curve, thereby allowing the coupler body to be drawn forth from the holder to turn following the curve.

4. The automatic coupler according to claim 2, wherein said guide mechanism is composed of a guide pin provided on an upper or lower surface of the coupler trunk, in a part of the coupler trunk nearer to the proximal end, and a guide groove provided in the upper or lower holder member, the guide groove including two parts extending from a point nearer to the proximal end of the upper or lower holder member, diagonally to the opposite sides, toward the distal end of the upper or lower holder member, and thus having an approximate V-shape as a whole, wherein the guide groove is adapted to receive said guide pin in a manner preventing the coupler body from coming off the holder and allowing the guide pin to shift into such one of said two parts of the guide groove that corresponds to an inside of a curve when the car travels on the curve, thereby allowing the coupler body to be drawn forth from the holder to turn following the curve.

* * * * *